US005470251A

United States Patent [19]

Sano

[11] Patent Number: 5,470,251

[45] Date of Patent: Nov. 28, 1995

[54] CONNECTOR ENGAGEMENT DETECTING DEVICE

[75] Inventor: Minoru Sano, Hachioji, Japan

[73] Assignee: Molex Incorporated, Lisle, Ill.

[21] Appl. No.: 300,822

[22] Filed: Sep. 2, 1994

[30] Foreign Application Priority Data

Sep. 24, 1993 [JP] Japan ..... 5-261526

[51] Int. Cl.[6] ..... H01R 3/00

[52] U.S. Cl. ..... 439/489; 439/188

[58] Field of Search ..... 200/51.09, 51.1; 439/188, 488, 489, 490, 931, 345, 353, 354, 357

[56] References Cited

U.S. PATENT DOCUMENTS

| | | | |
|---|---|---|---|
| 4,452,501 | 6/1984 | Gladd et al. . | |
| 4,871,323 | 10/1989 | Ohsumi | 439/188 |
| 4,878,853 | 11/1989 | Yamade et al. | 439/490 X |
| 5,035,644 | 7/1991 | Nakazato et al. | 439/372 |
| 5,055,058 | 10/1991 | Nagasaka et al. | 439/188 |
| 5,066,244 | 11/1991 | Kato et al. | 439/489 |
| 5,112,246 | 5/1992 | Kawase et al. | 439/489 |
| 5,127,848 | 7/1992 | Taguchi | 439/489 |
| 5,131,865 | 7/1992 | Taguchi et al. | 439/489 |
| 5,141,454 | 8/1992 | Garrett et al. | 439/931 X |
| 5,158,473 | 10/1992 | Takahashi et al. | 439/353 |
| 5,277,608 | 1/1994 | Oda | 439/489 X |

*Primary Examiner*—Khiem Nguyen
*Attorney, Agent, or Firm*—A. A. Tirva

[57] ABSTRACT

An electrical connector is equipped with a device for detecting the mating and unmating of the male an female parts of the connector. The male part has an integral latchpiece and a pair of terminal pins connected to an associated detector circuit for detecting the mating of the male and female pars of the electric connector. The female part has an integral counter latching projection and an electrical conductor mounted on the counter latching projection for electrically connecting the pair of pins upon the mating-and-looking of the male and female parts. The counter latching projection functions as switching means responsive to the mating and unmating of the male and female parts of the electrical connector permitting the detector to detect the mating and unmating of the male and female parts.

5 Claims, 10 Drawing Sheets

CONNECTOR ENGAGEMENT DETECTING DEVICE

FIELD OF THE INVENTION

The present invention relates to an electrical connector assembly equipped with means for detecting the mating of its male and female housings.

BACKGROUND OF THE INVENTION

Japanese Utility Model Application, Public Disclosure No. 5-8882 discloses an electrical connector assembly capable of detecting the mating of its male and female housings. The male housing includes a plurality of pin terminals and the female housing includes a plurality of receptacle terminals.

In this prior art connector the male and female housings are molded of a synthetic resin material, and each housing is composed of a main body and an associated separate cover. The main body of one of these housings has an integrally molded lever. The lever has contacts on its opposite arms, and when the male and female housings are mated, the contacts of the lever of the male (or female) housing engage the contacts provided on the surface of the female (or male) housing facing the male (or female) housing, thereby permitting an associated detector circuit to detect the mating of the male and female parts.

This type of detecting arrangement is useful in detecting the mating of the male and female housings. It, however, requires the lever on the male (or female) housing and the associated contacts on the female (or male) housing for cooperating with lever's contacts to close an associated detector circuit, thereby detecting the mating of the male and female housings. A problem with such an arrangement is that the mechanical male-and-female mating action is effected separately from the electrical detection and an indication of the completed connection of the male and female housing is possible in spite of incomplete mating of the connector housings.

Furthermore, such a connector requires extra number of parts such as a lever and associated elements, thereby increasing the manufacturing cost.

SUMMARY OF THE INVENTION

One object of the present invention is to provide an electrical connector which is capable of detecting the mating of its male and female housings.

Another object of the present invention is to provide an electrical connector requiring minimum number of parts.

These and other objects are attained by an electrical connector capable of detecting the mating of its male and female housings wherein the male housing contains a plurality of pin terminals, and the female housing contains a plurality of receptacle terminals. The improvement, according to the present invention, includes an integral latching arm on the male housing incorporating a pair of pin terminals connected to a detector circuit for detecting the mating of the male and female housings of the electric connector. The female housing has an integral latching projection and an electrical conductor attached to latching projection for electrically connecting the pair of pin terminals upon the mating-and-locking of male and female housings.

The female housing may be molded and the latching projection may be part of the molded body having an electrical conductor mounted on it, or the latching projection may have an electrical conductor plated on it.

The latch projection may also be a separate metal piece fixed to the female housing.

In the subject arrangement the mating of the male and female housings of an electric connector causes the mechanical locking of the parts and, at the same time the electrical connection of the pair of detecting pin terminals of an associated circuit, signaling the mating of the male and female housings of the electric connector.

BRIEF DESCRIPTION OF THE DRAWINGS

Other objects and advantages of the present invention will be understood from the following description of an electrical connector according to one preferred embodiment of the present invention, which is shown in the accompanying drawings.

DETAILED DESCRIPTION OF THE PREFERRED EMBODIMENT

Figure 1:
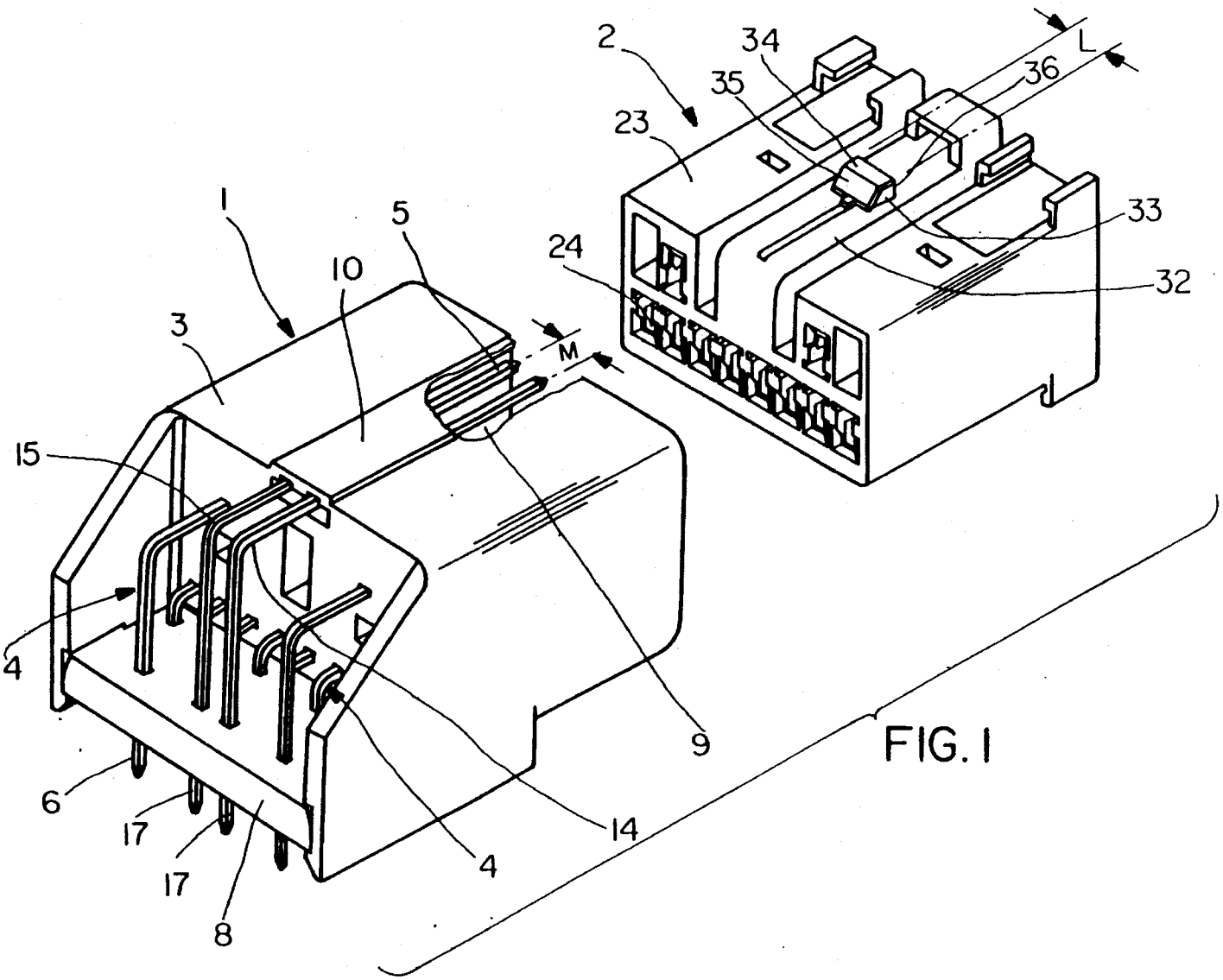
FIG. 1 is a perspective view of the male and female housings of an electrical connector according to the present invention prior to the mating of these housings.
Figure 2:
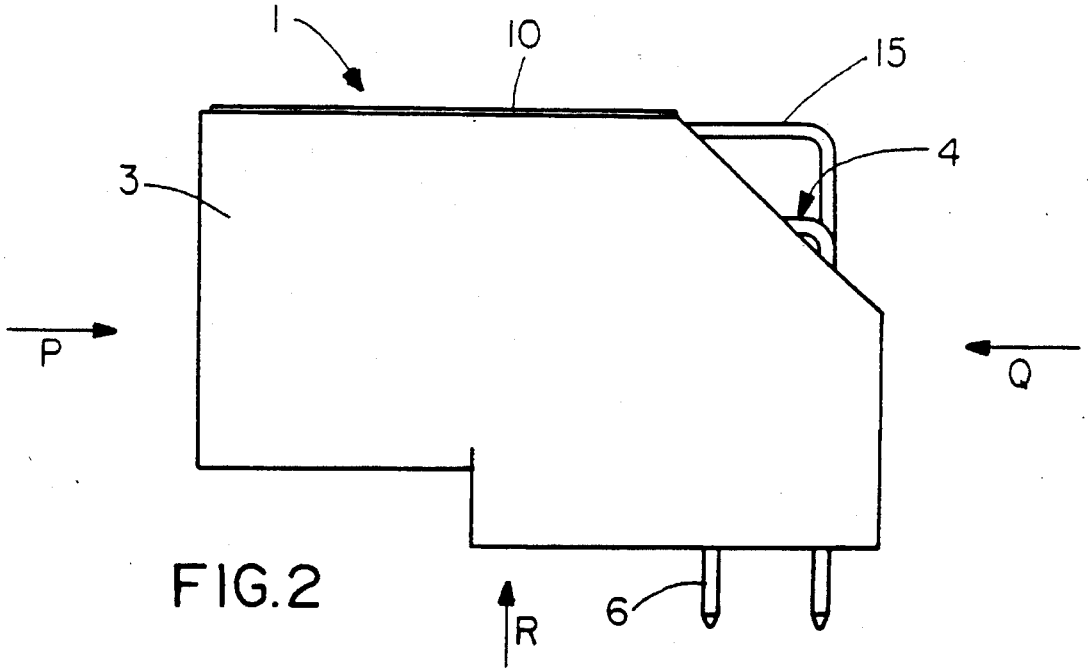
FIG. 2 is a side view of the male housing.
Figure 3:
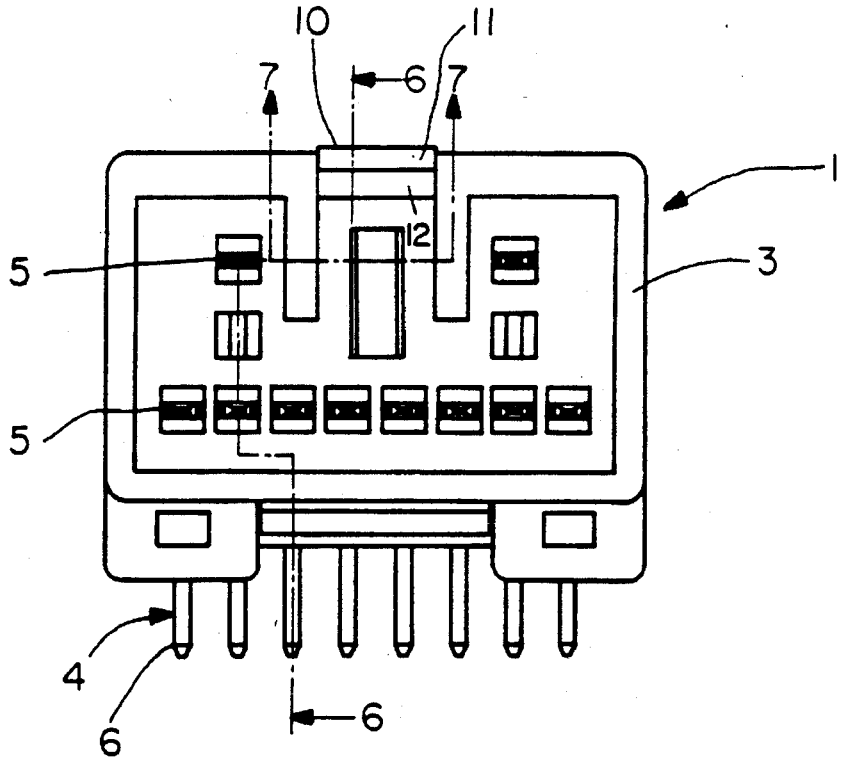
FIG. 3 is a view of the male housing as seen in the direction indicate by "P" in FIG. 2.
Figure 4:
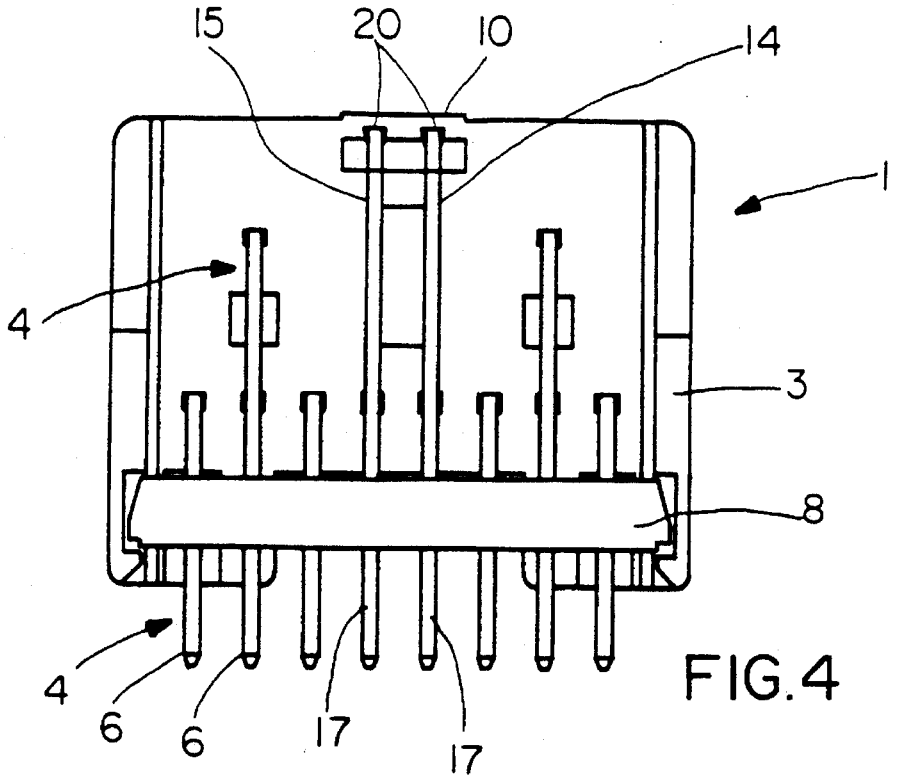
FIG. 4 is a view of the male housing as seen in the direction indicate by "Q" in FIG. 2.
Figure 5:
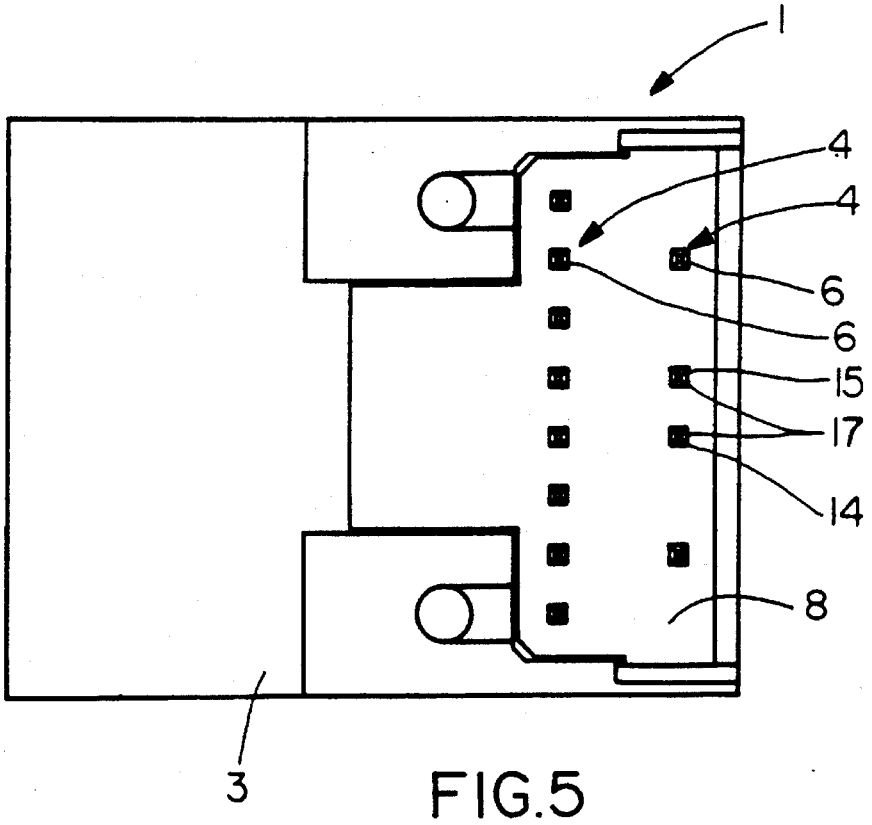
FIG. 5 is a view of the male housing as seen in the direction indicated by "R" in FIG. 2.

Referring to FIGS. 1 to 7, a male part 1 of an electrical connector has a plug housing 3 and a plurality of plug or pin terminals 4 mounted in the plug housing 3. In this particular embodiment two pin terminals and eight pin terminals are arranged at regular intervals in the upper and lower rows of the plug housing 3, respectively. Each pin terminal has an "L"-shape, and is composed of a contact leg 5 and a solder tail 6. The "L"-shaped pin terminals 4 are inserted in the terminal receiving cavities 7 in the plug housing 3. Specifically, the contact legs 5 are held by the contact holding wall, extending into the space 9 of the plug housing 3, in which space the receptacle housing 2 of a female part 2 is to be fitted whereas the solder tails 6 are held by a solder tail holding flat 8.

The male part 1 has a latching projection 11 integral with the upper, rear edge of a ceiling plate 10 of the plug housing 3. The latching projection 11 has a leading tapered side 12 and a tailing tapered side 13. Projection 11 is designed to engage a counter latching projection 33 which is integral to a receptacle housing 23 of the female part 2, as described later.

The plug housing 3 additionally has a pair of parallel terminal pins 14 and 15 connected to a detector circuit 50 for detecting the mating of the male and female parts 1 and 2 of the electrical connector.

Figure 6:
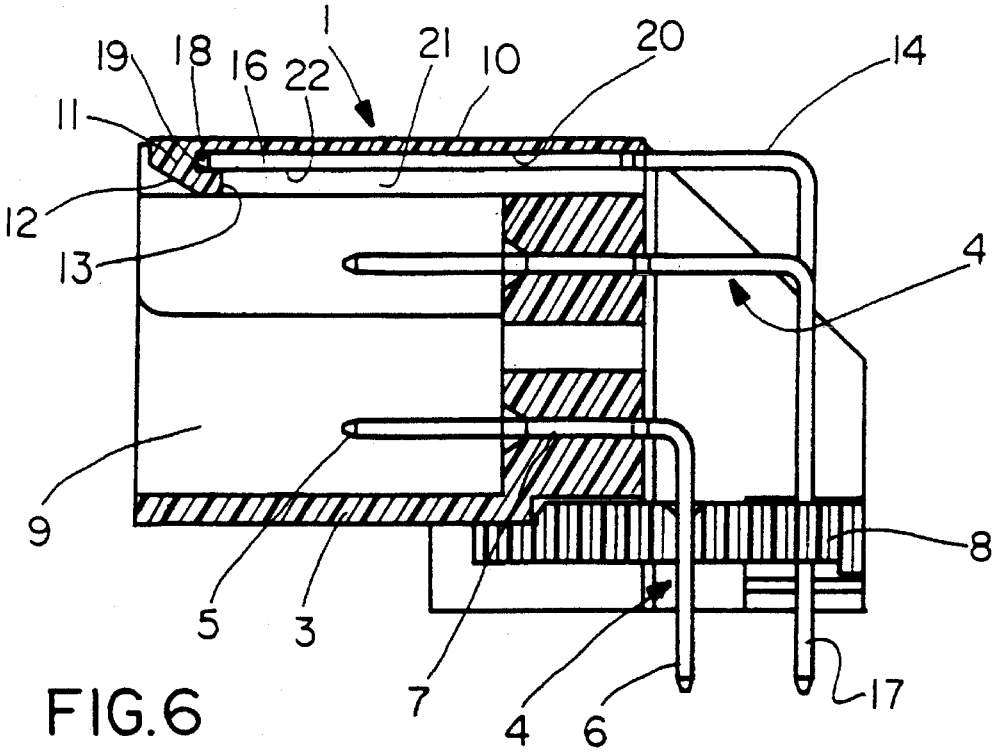
FIG. 6 is a cross-section taken along the line 6—6 in FIG. 3.
Figure 7:
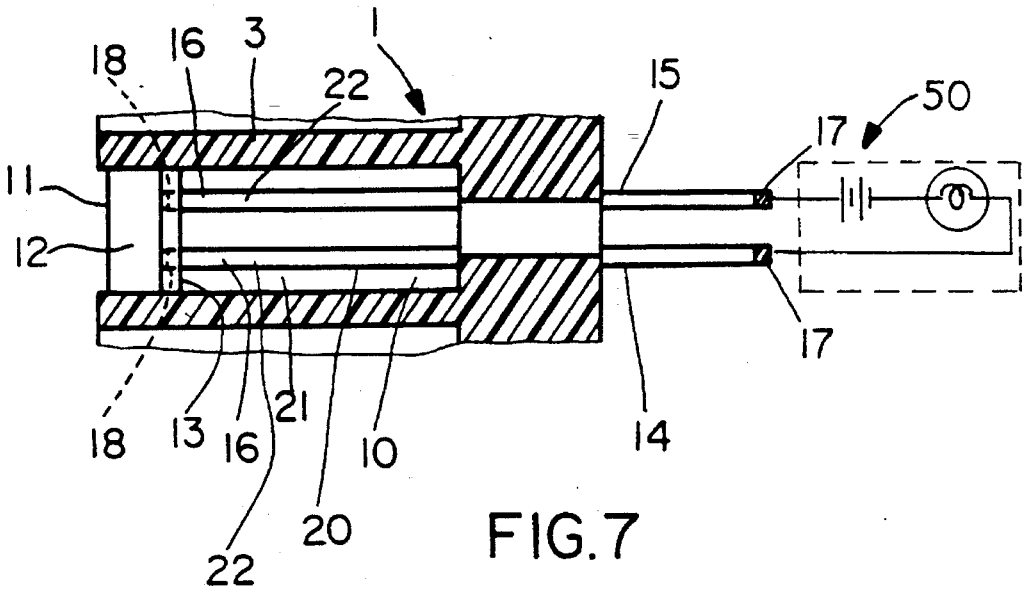
FIG. 7 is a cross-section taken along the line 7—7 in FIG. 3.
Figure 8:
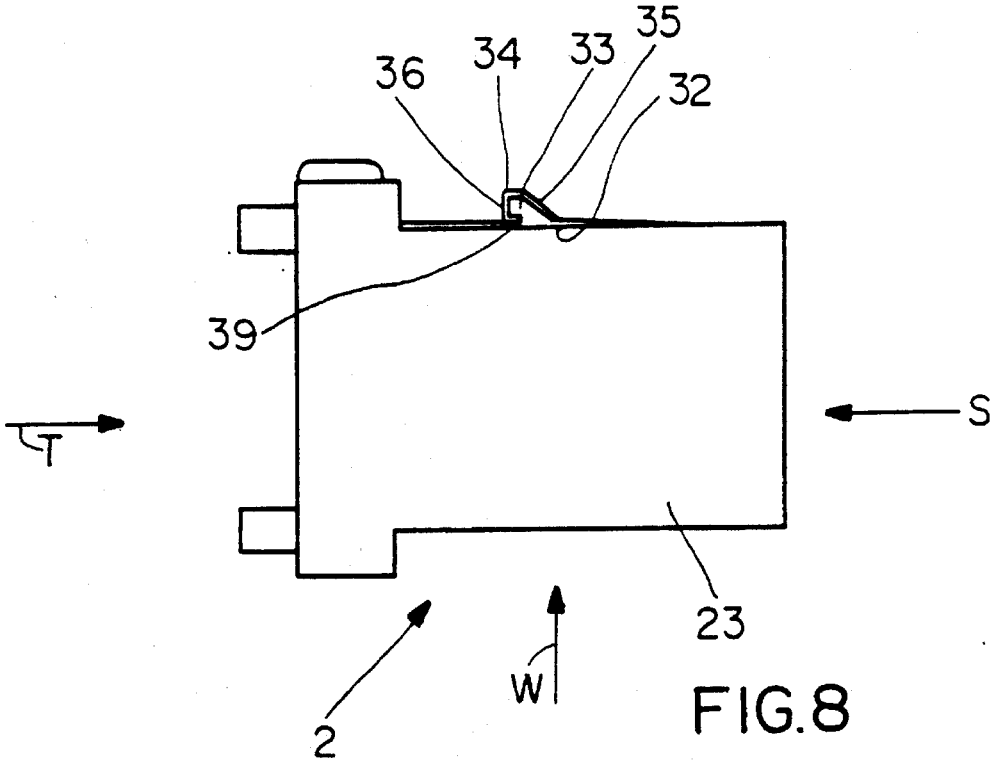
FIG. 8 is a side view of the female housing.
Figure 9:
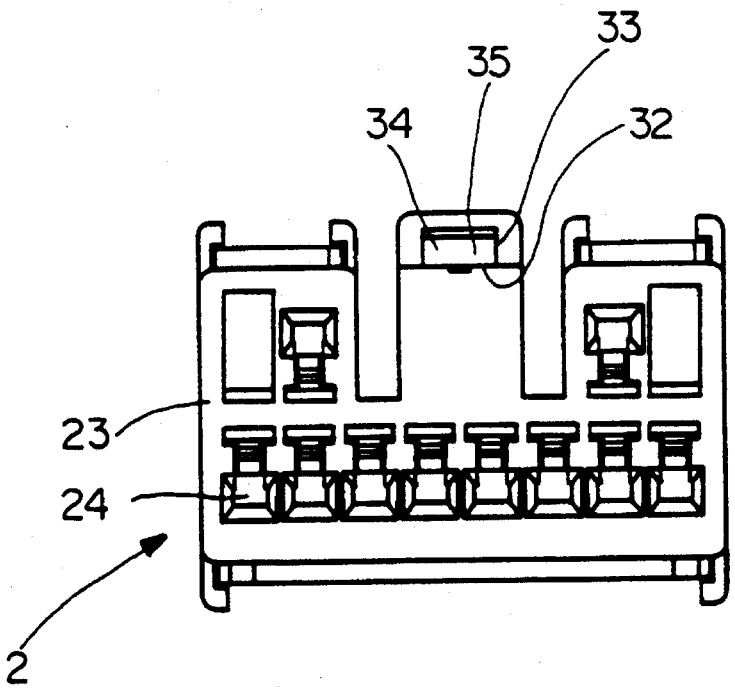
FIG. 9 is a view of the female housing as seen in the direction indicated by "S" in FIG. 8.
Figure 10:
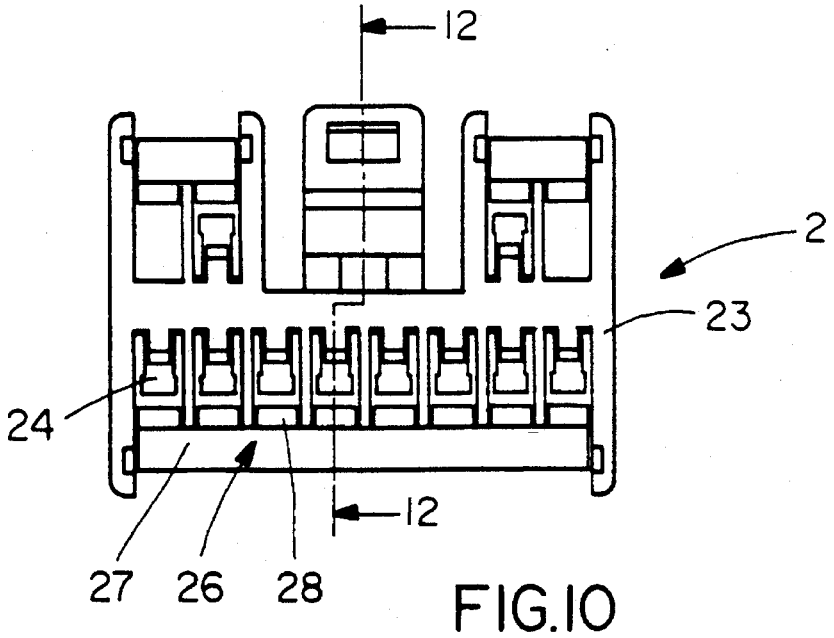
FIG. 10 is a view of the female housing as seen in the direction indicated by "T" in FIG. 8.
Figure 11:
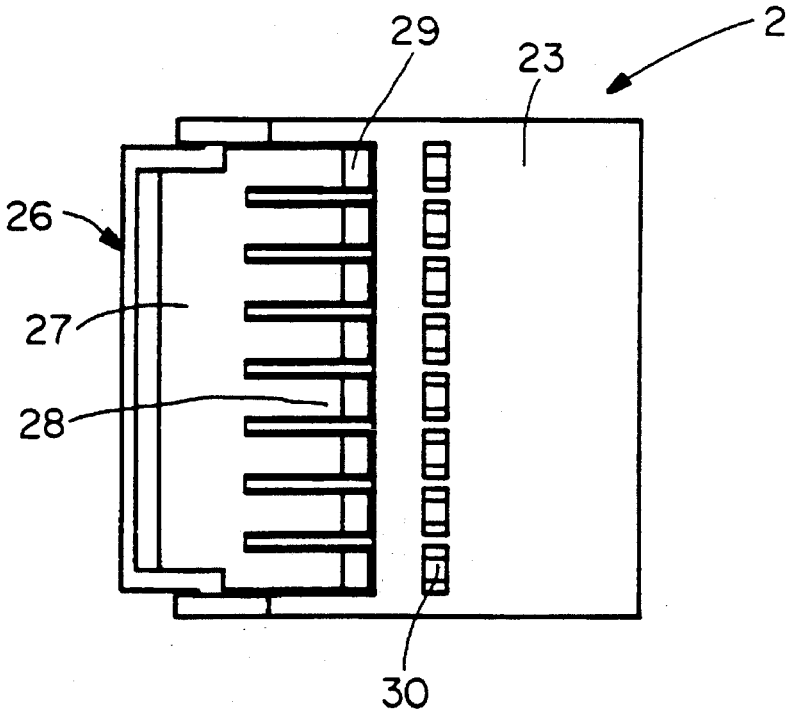
FIG. 11 is a view of the female housing as seen in the direction indicated by "W" in FIG. 8.

As best seen from FIGS. 6 and 7, each detecting terminal pin 14 and 15 has an "L"-shape, and one end 16 of the "L"-shaped pin 14 is adapted to contact a pin-bridging conductor 34 on the counter latch piece 33 of the female part 2 for electrically connecting the pair of detecting pins 14 and 15, as later described. The other end 17 of the "L"-shaped pin is adapted to be connected to the detector circuit provided in a printed circuit board (not shown). The tip of the horizontal end 16 of each detecting pin 14 and 15 is fitted in a lateral slot 19 of the body 13 of the latching projection 11, and the whole length of the leg 16 is fitted in a longitudinal slot 20 of the ceiling plate 10. The vertical leg 17 of each detecting terminal pin is held by the tail holding flat 8.

An upper, longitudinal space 21 extending behind the body 13 of the latching projection 11 communicates with the lower space 9 for accommodating the receptacle housing 23. The horizontal leg 16 of each detecting terminal pin is held in the upper, longitudinal space 21, exposing its circumferential surface 22 to contact the bridging conductor 34 on the counter latching projection 33 of the female part 2 when the female part 2 is fitted in the lower space 9 of the plug housing 3.

Now, referring to FIG. 1 and FIGS. 8 to 16, the female part 2 of the electric connector has a receptacle housing 23 and a plurality of receptacle terminals 25 mounted in the terminal recesses 24 in the receptacle housing 23. In this particular embodiment two receptacle terminals and eight receptacle terminals are arranged at regular intervals in the upper and lower rows of the receptacle housing 23 respectively, so that the pin terminals of the male part 1 may be inserted in the receptacle terminals 24 of the female part 2.

Figure 12:
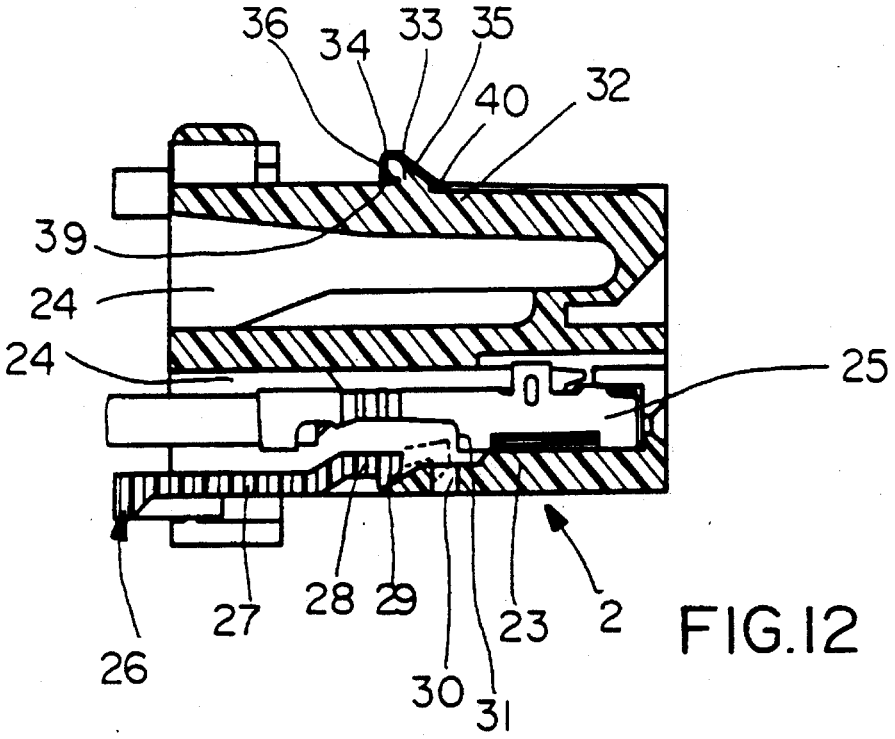
FIG. 12 is a section taken along the line 12—12 in FIG. 10.
Figure 17:
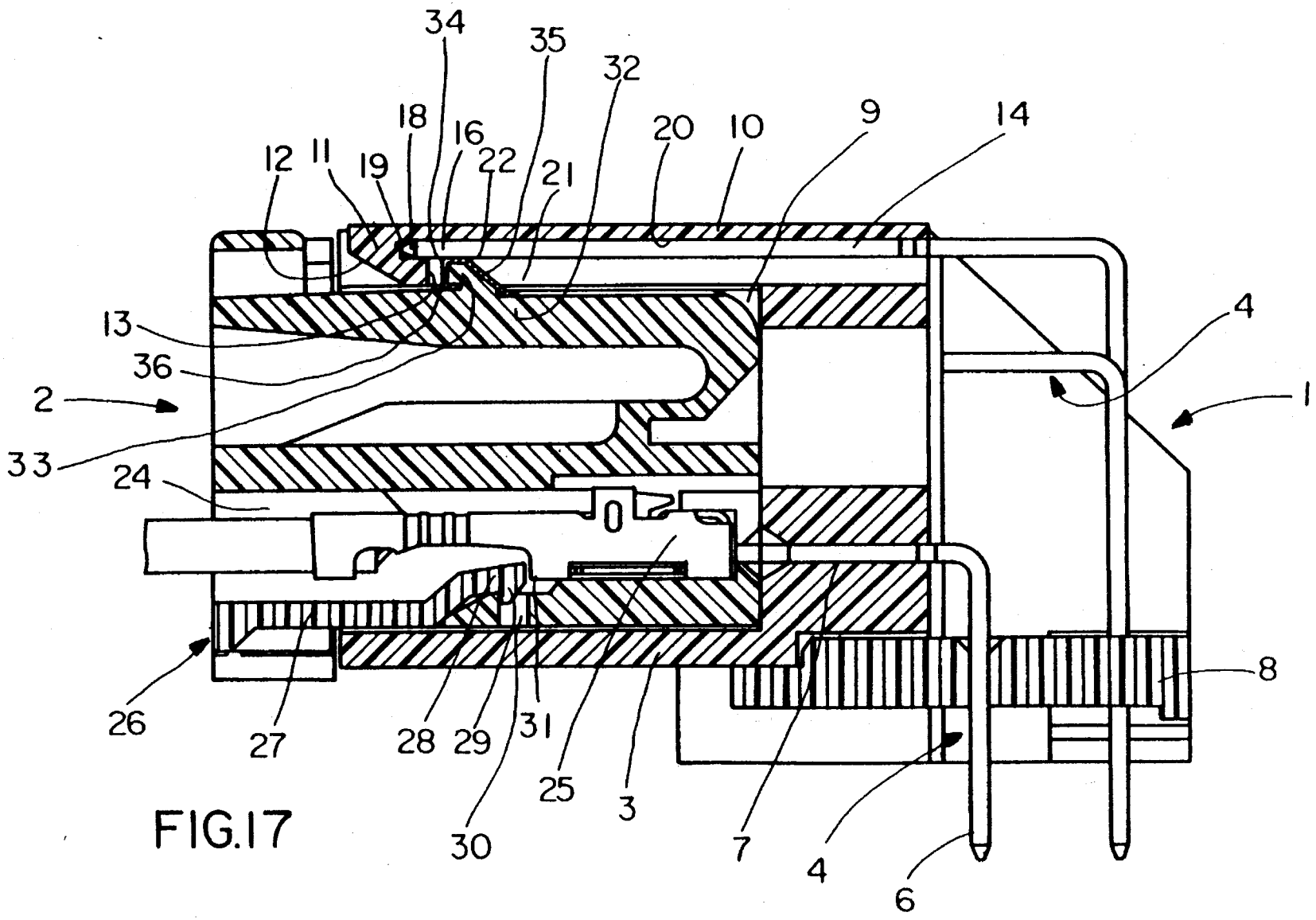
FIG. 17 is a longitudinal section of the electrical connector with its male and female housings mated.

As seen in FIG. 17, a spacer 26 is used to prevent receptacle terminals 25 from slipping out from the recesses 24 of the receptacle housing 23. The spacer 26 is composed of a base 27 and a plurality of engagement extensions 28 each having projection 29 integrally connected to its tip end. The spacer 26 is inserted fully in the receptacle housing 23 until its projections 29 have engaged a lateral slot 30 of the receptacle housing 23. The projection 29 then engage an edge 31 of each receptacle terminal 25, thus preventing the removal of the receptacle terminals 25 from the receptacle housing 23. In FIG. 12, the spacer 26 is shown in the provisionally inserted position (solid line) and in the fully inserted position (broken line). In the fully inserted position the spacer prevents the removal of the receptacle terminals.

The receptacle housing 23 has a counter latching projection 33 integral with its ceiling plate 32. The counter latching projection 33 has a leading tapered surface 35, followed by a horizontal surface 51 and a vertical rear surface 36 complementary to the surfaces of latching projection 11 of the plug housing 3. A contact 34 is fastened to the counter latching projection 33. The central feature of the electrical connector resides in the counter latching projection 33 functioning also as switching means to electrically interconnect the parallel pins 14, 15 for driving a detector circuit 50 to sense the mating of the male and female parts 1 and 2 of the electrical connector. Preferably the contact 34 has a width "L" somewhat larger than the inter-distance "M" between the parallel terminal pins 14 and 15.

Figure 13:
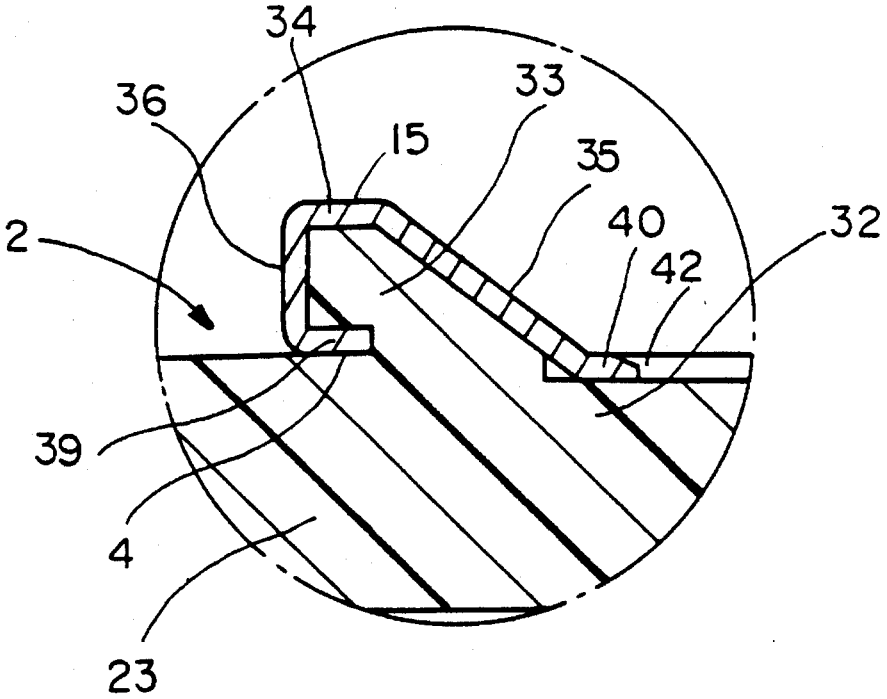
FIG. 13 is an enlarged section of an electrical conductor for bridging a pair of detecting pin terminal for detecting the mating of the male and female housings of the electrical connector.
Figure 14:
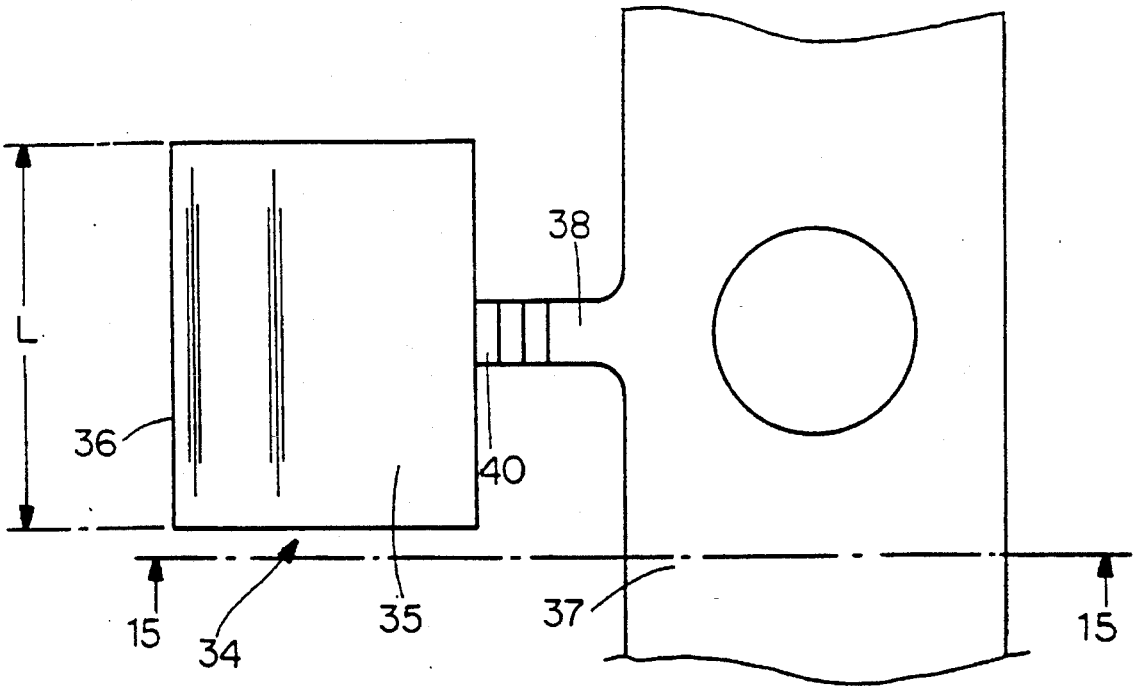
FIG. 14 an enlarged plan view of the pin terminal bridging electrical conductor.
Figure 15:
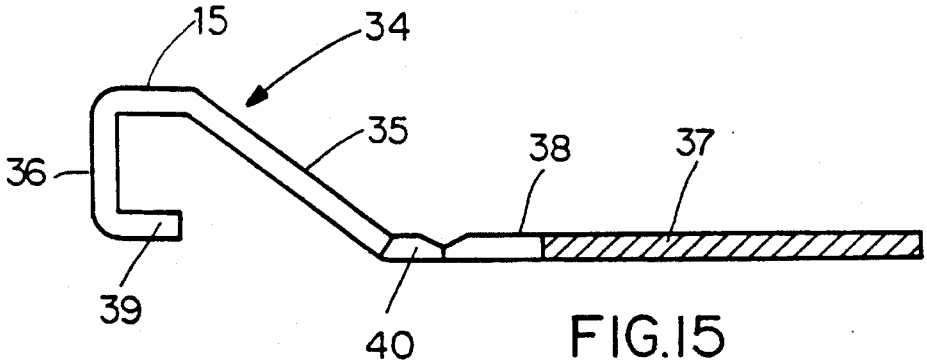
FIG. 15 a is a section of the pin terminal bridging electrical conductor taken along the line 15—15 in FIG. 14.
Figure 16:
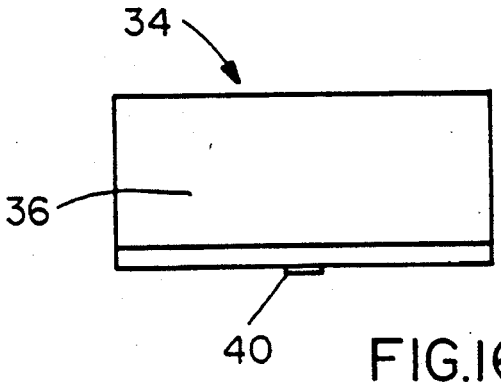
FIG. 16 is a front view of the pin terminal bridging electrical conductor.

As shown in FIGS. 14 to 16, a plurality of contact pieces 34 are integrally connected to a carrier strip 38 via joints 38 before mounting on the counter latching projection 33. These conductor pieces 34 are cut and separated from the carrier strip 38. As best seen in FIG. 15, each conductor 34 is a hook-shaped portion which is composed of a horizontal catch section 39, a vertical rising section 36 integrally connected to the horizontal section 51, and a horizontal positioning section 40 integrally connected to the end of the horizontal-and-slant section 35. As best seen in FIG. 13, the conductor 34 is attached do the counter latch piece 33 by inserting the horizontal catch section 39 of the conductor in the lateral slot 41 of the vertical section 36 of the counter latching projection 33, thereby preventing the slipping-off of the conductor 34 from the counter latching projection 33 against a pull-up force, and by inserting the horizontal positioning section 40 of the conductor 34 in a longitudinal slot 42 of the ceiling plate 32, thereby preventing the lateral movement of the conductor 34.

Figure 18:
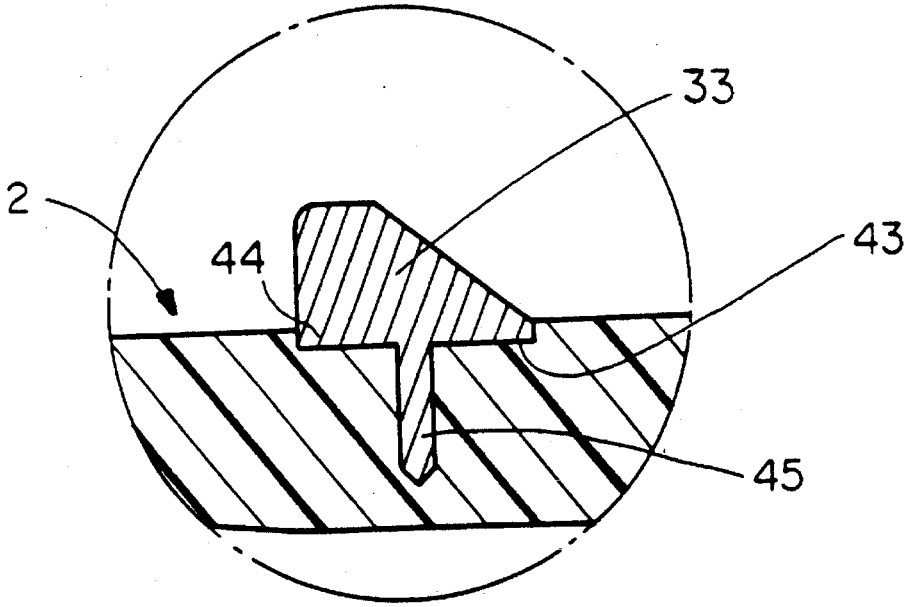
FIG. 18 is an enlarged section of another pin terminal bridging electrical conductor.
Figure 19:
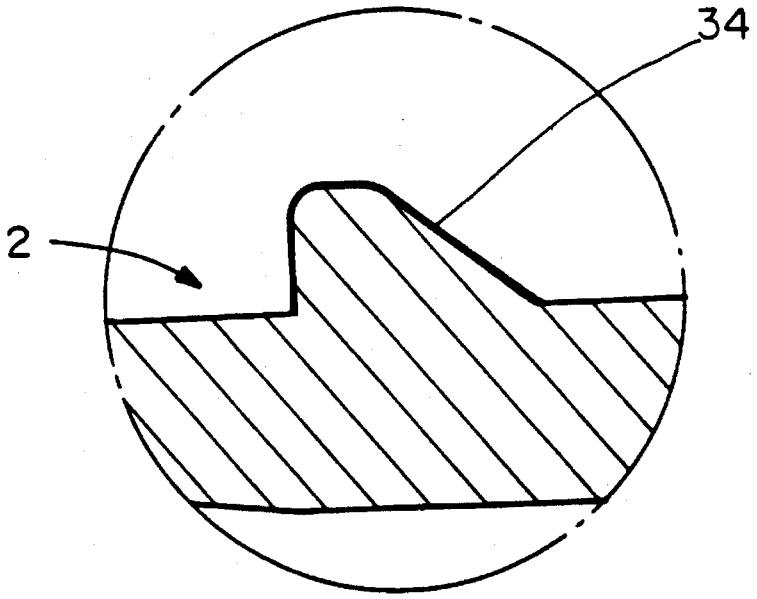
FIG. 19 is an enlarged section of still another pin terminal bridging electrical conductor.

As shown in FIG. 18, the counter latching projection 33 may be made from solid metal, and it may be fixed by embedding its bottom 44 in a recess 43 and inserting its leg 45 in a vertical slot of the recess 43 in the ceiling plate. Alternatively, the conductor 34 may be provided by plating the counter latching projection, as shown in FIG. 19.

Referring to FIG. 17, it illustrates the manner in which the mating of the male part 1 and the female part 2 of the electric connector can be detected.

As the receptacle housing 23 of the female part 2 is inserted in the space 9 of the plug housing 3 of the male part 1, the tapered surface 35 of the conductor 34 on the counter latching projection 33 abuts the tapered surface 12 of the latching projection 11. The counter latching projection 33 rides under the latching projection 11 to enter the space 21 placing the vertical surface 36 of the counter latching projection 33 in contact with the vertical surface 13 of the latching projection 11 to lock the male and female parts 1 and 2 together. In this locked condition the pin terminals 4 are inserted in the receptacle terminals 25, and at the same time, the tip ends of the parallel pins 14 and 15 are positioned on the conductor 34 of the counter latching projection 33, thereby enabling the associated detector circuit 51 to sense the mating of the male and female parts 1 and 2, by turning a light "on" or generating some other type of a signal.

When the male and female parts 1 and 2 are separated from each other by disengaging the latching projection 11 and the counter latching projection 33, the parallel pins 14 and 15 are put in non-conductive condition enabling sensing the unmating of the male and female parts 1 and 2.

As may be understood from the above, use is made of a counter latching projection 33 functioning as switching means responsive to the mating and unmating of the male and female parts of an electric connector allowing an associated detector to detect the mating and unmating of the male and female parts, and advantageously this requires only a conductor fixed to the counter latching projection or as a counter latching projection made of a conductive material.

I claim:

1. An electrical connector comprising, a pair of mating dielectric connector bodies, a plurality of electrical terminals in one connector body adapted to engage a plurality of electrical contacts in the other connector body when the connector bodies are mated, a resilient latching arm having a top and a bottom surface and including a locking projection at its free end on one connector body and a cooperating latching projection on the other connector body, the latching projection having a top surface and a latch surface substantially normal to the top surface for engaging the locking projection to lock the mated connector bodies together, an electrical contact mounted to cover only on the top surface of the locking projection, a pair of terminals having free ends mounted on an inner top side of the connector body having said latching projection with the free ends of the terminals located in a recess in the latching projection, whereby the terminals are bridged by the electrical contact when the connector bodies are fully mated and the latching projection engages the locking projection.

2. An electrical connector in accordance with claim 1, wherein the connector bodies are molded of a plastic material and the latching arm and the locking projection are each integral portions of the respective connector bodies.

3. An electrical connector in accordance with claim 2, wherein the electrical contact mounted on the locking projection is stamped and formed from a flat piece of material.

4. An electrical connector in accordance with claim 2, wherein the electrical contact mounted on the locking projection is plated on the top surface of the locking projection.

5. An electrical connector in accordance with claim 1, wherein the locking projection is a separate metal piece mounted on the connector body.

* * * * *